US009828651B2

(12) United States Patent
Hino et al.

(10) Patent No.: US 9,828,651 B2
(45) Date of Patent: Nov. 28, 2017

(54) METHOD AND APPARATUS OF MANUFACTURING HIGH STRENGTH COLD ROLLED STEEL SHEET

(75) Inventors: Yoshimichi Hino, Tokyo (JP); Gentaro Takeda, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 330 days.

(21) Appl. No.: 14/386,225

(22) PCT Filed: Mar. 19, 2012

(86) PCT No.: PCT/JP2012/057003

§ 371 (c)(1),
(2), (4) Date: Sep. 18, 2014

(87) PCT Pub. No.: WO2013/140495

PCT Pub. Date: Sep. 26, 2013

(65) Prior Publication Data

US 2015/0047758 A1 Feb. 19, 2015

(51) Int. Cl.

| | |
|---|---|
| ***C21D 9/46*** | (2006.01) |
| ***C21D 8/04*** | (2006.01) |
| ***C21D 1/63*** | (2006.01) |
| ***C21D 1/18*** | (2006.01) |
| ***C21D 1/60*** | (2006.01) |

(Continued)

(52) U.S. Cl.

CPC ..... *C21D 9/46* (2013.01); *C21D 1/18* (2013.01); *C21D 1/26* (2013.01); *C21D 1/60* (2013.01); *C21D 1/63* (2013.01); *C21D 1/667* (2013.01); *C21D 8/0436* (2013.01); *C21D 9/573* (2013.01); *C21D 9/5735* (2013.01); *C21D 11/005* (2013.01); *C22C 38/00* (2013.01); *C21D 9/0062* (2013.01); *C21D 2221/00* (2013.01); *C21D 2221/02* (2013.01)

(58) Field of Classification Search

CPC ..... C21D 9/46; C21D 1/18
USPC ..... 148/661
See application file for complete search history.

(56) References Cited

U.S. PATENT DOCUMENTS

| | | | | |
|---|---|---|---|---|
| 4,724,014 | A | 2/1988 | Misawa | |
| 2011/0270433 | A1 | 11/2011 | Claveroulas | |
| 2015/0047758 | A1 * | 2/2015 | Hino | C21D 9/46 148/661 |

FOREIGN PATENT DOCUMENTS

| | | |
|---|---|---|
| EP | 2740808 | 6/2014 |
| EP | 2792756 | 10/2014 |

(Continued)

OTHER PUBLICATIONS

Machine generated English Langiage translation of JP H02-038532 Jul. 1988.*

(Continued)

*Primary Examiner* — Scott Kastler
(74) *Attorney, Agent, or Firm* — RatnerPrestia

(57) ABSTRACT

A method for manufacturing a high-strength cold-rolled steel sheet includes a temperature distribution forming step of forming a temperature distribution in a width direction of a steel sheet such that a temperature of the steel sheet increases from an end of the steel sheet in the width direction toward a center part of the steel sheet in the width direction, and a water quenching step of performing water quenching treatment on the steel sheet by immersing, in cooling water, the steel sheet on which the temperature distribution is formed in the width direction.

4 Claims, 12 Drawing Sheets

(51) Int. Cl.

| | |
|---|---|
| ***C22C 38/00*** | (2006.01) |
| ***C21D 9/573*** | (2006.01) |
| ***C21D 11/00*** | (2006.01) |
| ***C21D 1/26*** | (2006.01) |
| ***C21D 1/667*** | (2006.01) |
| *C21D 9/00* | (2006.01) |

(56) References Cited

FOREIGN PATENT DOCUMENTS

| | | |
|---|---|---|
| JP | 02-038532 | 2/1990 |
| JP | 08-295946 | 11/1996 |
| JP | 11-193418 | 7/1999 |
| JP | 2002-294351 | 10/2002 |
| JP | 2004059970 | 2/2004 |

OTHER PUBLICATIONS

International Search Report dated Jun. 19, 2012, application No. PCT/JP2012/057003.
Chinese Office Action dated Oct. 13, 2015 in Chinese Application No. 201280071573.2, including English translation.
Extended European Search Report for European Application No. 12872285.7-1362 dated Oct. 23, 2015.
Chinese Office Action dated May 4, 2015 in Chinese Application No. 20128071573.2, including English language translation.

* cited by examiner

METHOD AND APPARATUS OF MANUFACTURING HIGH STRENGTH COLD ROLLED STEEL SHEET

CROSS REFERENCE TO RELATED APPLICATIONS

This is the U.S. National Phase application of PCT/JP2012/057003, filed Mar. 19, 2012, the disclosure of which is incorporated herein by reference in its entirety for all purposes.

FIELD OF THE INVENTION

The present invention relates to a method and an apparatus of manufacturing a high strength cold rolled steel sheet.

BACKGROUND OF THE INVENTION

In recent years, for the purpose of ensuring safety of vehicle occupants at the time of a vehicle crash and improving fuel economy by reducing the weight of a vehicle body, a high strength cold rolled steel sheet having a tensile strength of 750 MPa or more and a small thickness is actively used as a structural member of a vehicle. In order to manufacture such a steel sheet, it is effective to use a continuous annealing line equipped with a water quenching device so as to increase the volume ratio of a martensitic phase in the steel sheet (refer to Patent Literature 1). That is, a steel sheet is heated until reaching a temperature (water quenching temperature) at which the structure of the steel sheet becomes a mixed structure of a ferrite phase and an austenitic phase or a structure of an austenitic single phase, and thereafter, the steel sheet is immersed into water in the water quenching device so as to be cooled at a critical cooling rate or higher. Thus, it is possible to manufacture a steel sheet having a mixed structure of a ferrite phase and a martensitic phase or a structure of a martensitic single phase. The volume ratio of the martensitic phase increases as the water quenching temperature becomes higher, and the strength of the steel sheet becomes higher in proportion to the increase in the volume ratio of the martensitic phase.

When such water quenching treatment as described above is applied to increase the strength of a steel sheet, the steel sheet may be curved in a circular arc in the sheet width direction, and thus may no longer be flat after the water quenching treatment although having been flat before the water quenching treatment. This is because a rapid thermal contraction occurs due to a rapid temperature drop by the water quenching treatment, and the thermal contraction causes the steel sheet to buckle. If the flatness of the steel sheet is worsened, the threading performance in the continuous annealing line drops, thereby causing a drop in a feed speed of the steel sheet or a threading trouble, thus posing problems in the next process such as a stamping process. From such a background, there is proposed a method for suppressing the circular arc-shaped curvature associated with the water quenching treatment. Specifically, Patent Literature 2 discloses a technology that straightens the deformed portion of the steel sheet into a flat shape by applying a pressure obtained by pressing, during the water quenching treatment, the entire area in the width direction of front and rear surfaces of the steel sheet.

PATENT LITERATURE

Patent Literature 1: Japanese Patent Application Laid-open No. 2002-294351

Patent Literature 2: Japanese Patent Application Laid-open No. 11-193418

SUMMARY OF THE INVENTION

However, according to the study conducted by the inventors of the present invention, it has been found that the steel sheet after the water quenching treatment is rarely deformed into a circular arc in the sheet width direction, but mostly deformed in a pattern of a plurality of wrinkles (waves) in the sheet width direction. Such wrinkle-like deformation turns into draw marks by being rolled on a sink roll installed in a water tank of the water quenching device, and causes a reduction in the manufacturing yield of the steel sheet. For that reason, a technology that can suppress wrinkle-like deformation in the width direction of the steel sheet has been desired.

The present invention has been made in view of the problem described above. It is an object of the present invention to provide a method and an apparatus of manufacturing a high strength cold rolled steel sheet that can suppress wrinkle-like deformation in the width direction of a steel sheet.

To solve the problem described above and achieve the object, the present invention provides a manufacturing method of a high strength cold rolled steel sheet, the manufacturing method comprising: a temperature distribution forming step of forming a temperature distribution in a width direction of a steel sheet so that a temperature of the steel sheet increases from an end portion in the width direction of the steel sheet toward a central portion in the width direction of the steel sheet; and a water quenching step of applying water quenching treatment to the steel sheet by immersing into cooling water the steel sheet formed with the temperature distribution in the sheet width direction.

To solve the problem described above and achieve the object, the present invention also provides a manufacturing apparatus of a high strength cold rolled steel sheet, the manufacturing apparatus comprising: a temperature distribution forming unit that forms a temperature distribution in a width direction of a steel sheet so that a temperature of the steel sheet increases from an end portion in the width direction of the steel sheet toward a central portion in the width direction of the steel sheet; and a water quenching unit that applies water quenching treatment to the steel sheet by immersing into cooling water the steel sheet that is formed with the temperature distribution in the sheet width direction by the temperature distribution forming unit.

With the method and apparatus of manufacturing a high strength cold rolled steel sheet according to the present invention, it is possible to suppress wrinkle-like deformation in the width direction of a steel sheet.

DETAILED DESCRIPTION OF EMBODIMENTS OF THE INVENTION

A method and an apparatus of manufacturing a high strength cold rolled steel sheet according to an embodiment of the present invention will be described below.

Concept of the Present Invention

First of all, a concept of the method and apparatus of manufacturing a high strength cold rolled steel sheet according to the present invention will be described with reference to FIGS. 1A to 7C.

The inventors of the present invention have repeatedly made eager studies, and as a result, have found that a deformation state in the width direction of a steel sheet associated with water quenching treatment changes corresponding to a difference in temperature distribution in the width direction of the steel sheet. Description will be made below of results obtained by analyzing, using structural analysis simulation, the changes in thermal stress-induced deformation state of the steel sheet associated with the difference in temperature distribution in the sheet width direction.

Figure 1A:
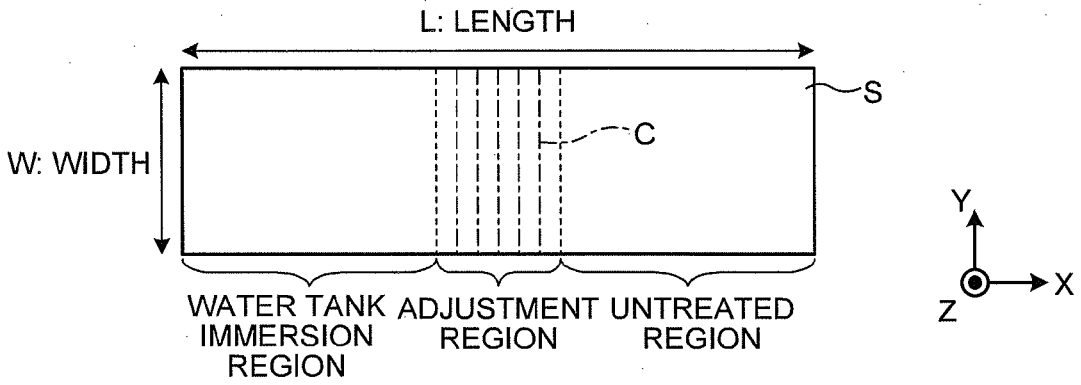
FIG. 1A is a diagram illustrating a structural analysis simulation model of a steel sheet in the case of forming a temperature distribution so that isotherms are in parallel with the water surface of a water quenching device.
Figure 1B:
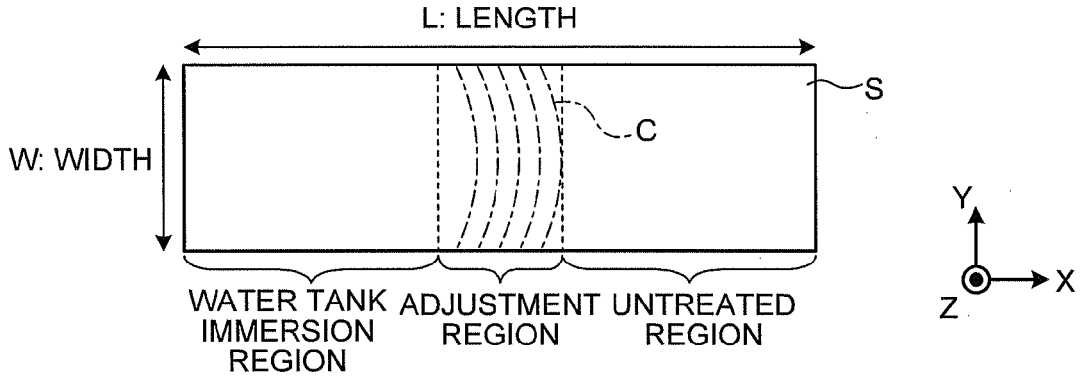
FIG. 1B is a diagram illustrating a structural analysis simulation model of a steel sheet in the case of forming a temperature distribution so that the isotherms have a concave circular arc pattern with respect to the water surface of the water quenching device.
Figure 1C:
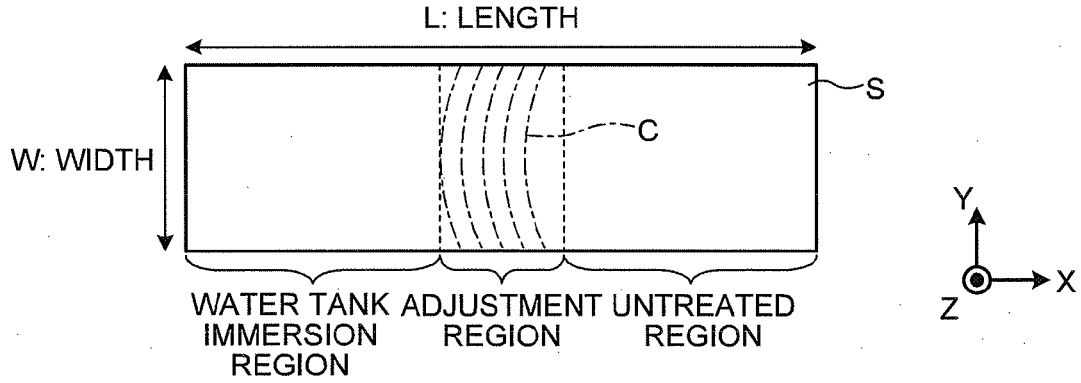
FIG. 1C is a diagram illustrating a structural analysis simulation model of a steel sheet in the case of forming a temperature distribution so that the isotherms have a convex circular arc pattern with respect to the water surface of the water quenching device.

FIGS. 1A to 1C illustrate structural analysis simulation models used for analyzing the changes in the deformation state of the steel sheet associated with the difference in temperature distribution in the sheet width direction. FIG. 1A illustrates a model (in parallel with water surface) in which a temperature distribution is formed so that isotherms C are in parallel with the water surface of a water quenching device. FIG. 1B illustrates a model (in concave shape with respect to water surface) in which a temperature distribution is formed so that the isotherms C have a concave circular arc pattern with respect to the water surface of the water quenching device. FIG. 1C illustrates a model (in convex shape with respect to water surface) in which a temperature distribution is formed so that the isotherms C have a convex circular arc pattern with respect to the water surface of the water quenching device.

As illustrated in FIGS. 1A, 1B, and 1C, the respective simulation models have the following defined regions: a water tank immersion region simulating a state of a steel sheet being immersed in the water quenching device, an adjustment region formed with a temperature distribution, and an untreated region formed with no temperature distribution in the sheet width direction. In the present embodiment, each of the simulation models has a thickness, a width W, and a length L of 0.8, 1200, and 5000 mm, respectively, and physical property values (true stress-true strain relation at 25 to 800° C., Young's modulus, Poisson's ratio, and average coefficient of linear thermal expansion) of low-carbon steel are used as physical property values of a steel sheet S. The water tank immersion region and the untreated region have temperatures of 40 and 740° C., respectively. The adjustment region is formed in the length direction thereof with a temperature distribution so that the temperature drops from the untreated region toward the water tank immersion region. Rotation is constrained about the X-axis in the drawing (length direction axis), the Y-axis in the drawing (sheet width direction axis), and the Z-axis in the drawing (thickness direction axis), and only a deformation in the Y-direction in the drawing is allowed. In this state, a general-purpose structural analysis software application (structural analysis software ABAQUS6.9 developed by SIMULIA) was used to analyze the changes in the deformation state of the steel sheet S associated with the difference in temperature distribution in the sheet width direction. An analysis result of each of the simulation models will be described below.

(Case of Forming Isotherms in Parallel with Water Surface)

Figure 2:
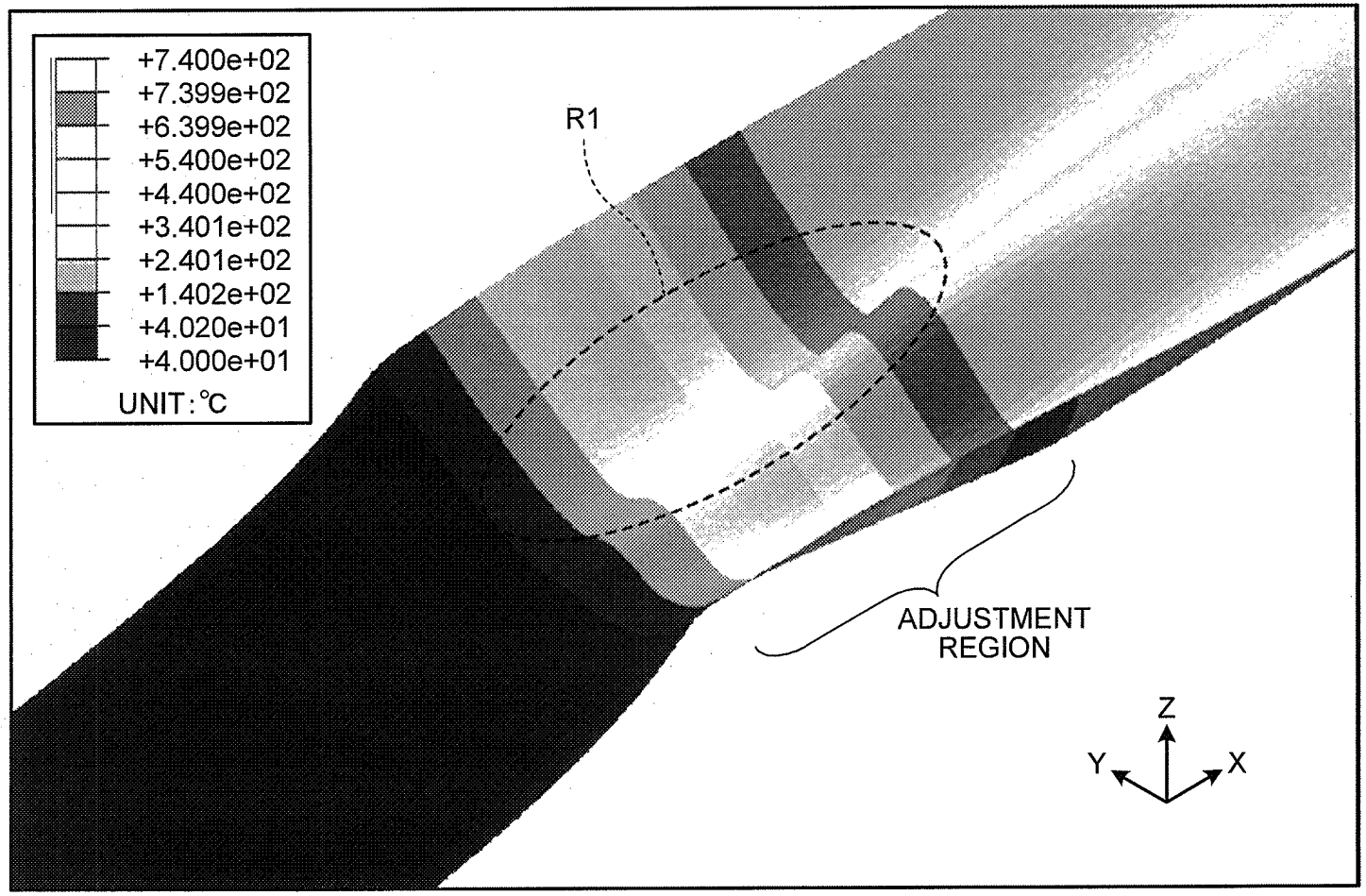
FIG. 2 is a diagram illustrating a simulation result of a steel sheet shape in the case of forming the temperature distribution so that the isotherms are in parallel with the water surface of the water quenching device.
Figure 5A:
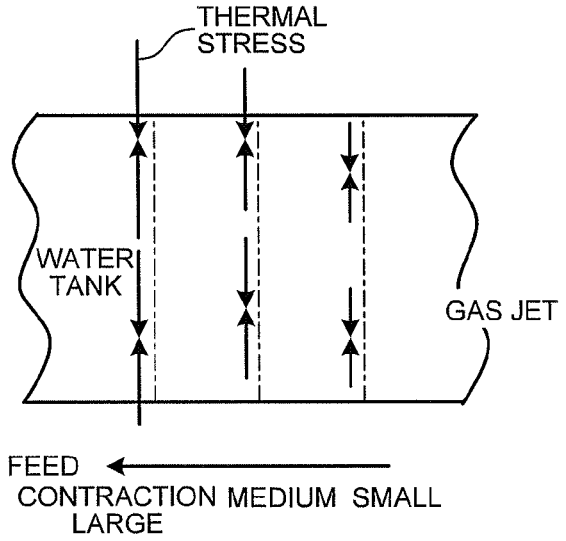
FIG. 5A is a schematic diagram explaining a state of thermal stresses on a sheet surface in the case of forming the temperature distribution so that the isotherms are in parallel with the water surface of the water quenching device.
Figure 6A:
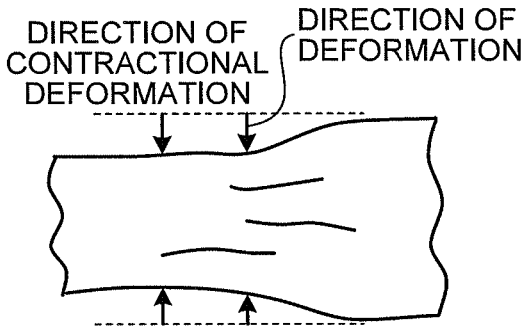
FIG. 6A is a schematic diagram explaining a shape of the sheet surface in the case of forming the temperature distribution so that the isotherms are in parallel with the water surface of the water quenching device.
Figure 7A:
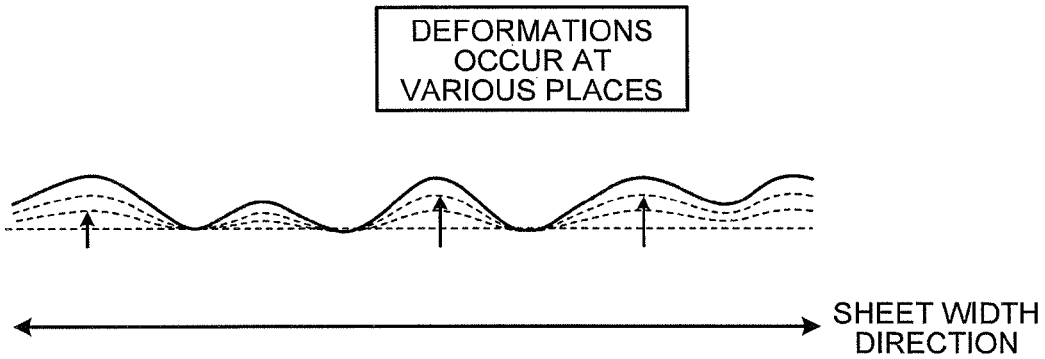
FIG. 7A is a schematic diagram explaining changes in deformation state of a steel sheet (deformation state of a cross section) in the case of forming the temperature distribution so that the isotherms are in parallel with the water surface of the water quenching device.

FIG. 2 is a diagram illustrating a simulation result of a steel sheet shape in the case of forming the temperature distribution so that the isotherms are in parallel with the water surface of the water quenching device (simulation model illustrated in FIG. 1A). As illustrated in FIG. 2, it is found that, in the case in which the temperature distribution is formed so that the isotherms are in parallel with the water surface of the water quenching device, the steel sheet is deformed in a wrinkle pattern in the sheet width direction, and the flatness of the steel sheet is greatly spoiled because the steel sheet greatly buckles in a central portion R1 of the adjustment region. The reason is considered as follows: In the case in which the temperature distribution is formed so that the isotherms are in parallel with the water surface of the water quenching device, thermal stresses associated with thermal contraction occur in a random manner in a plurality of portions located in the sheet width direction, as illustrated in FIGS. 5A, 6A, and 7A.

(Case of Forming Isotherms in Concave Shapes with Respect to Water Surface)

Figure 3:
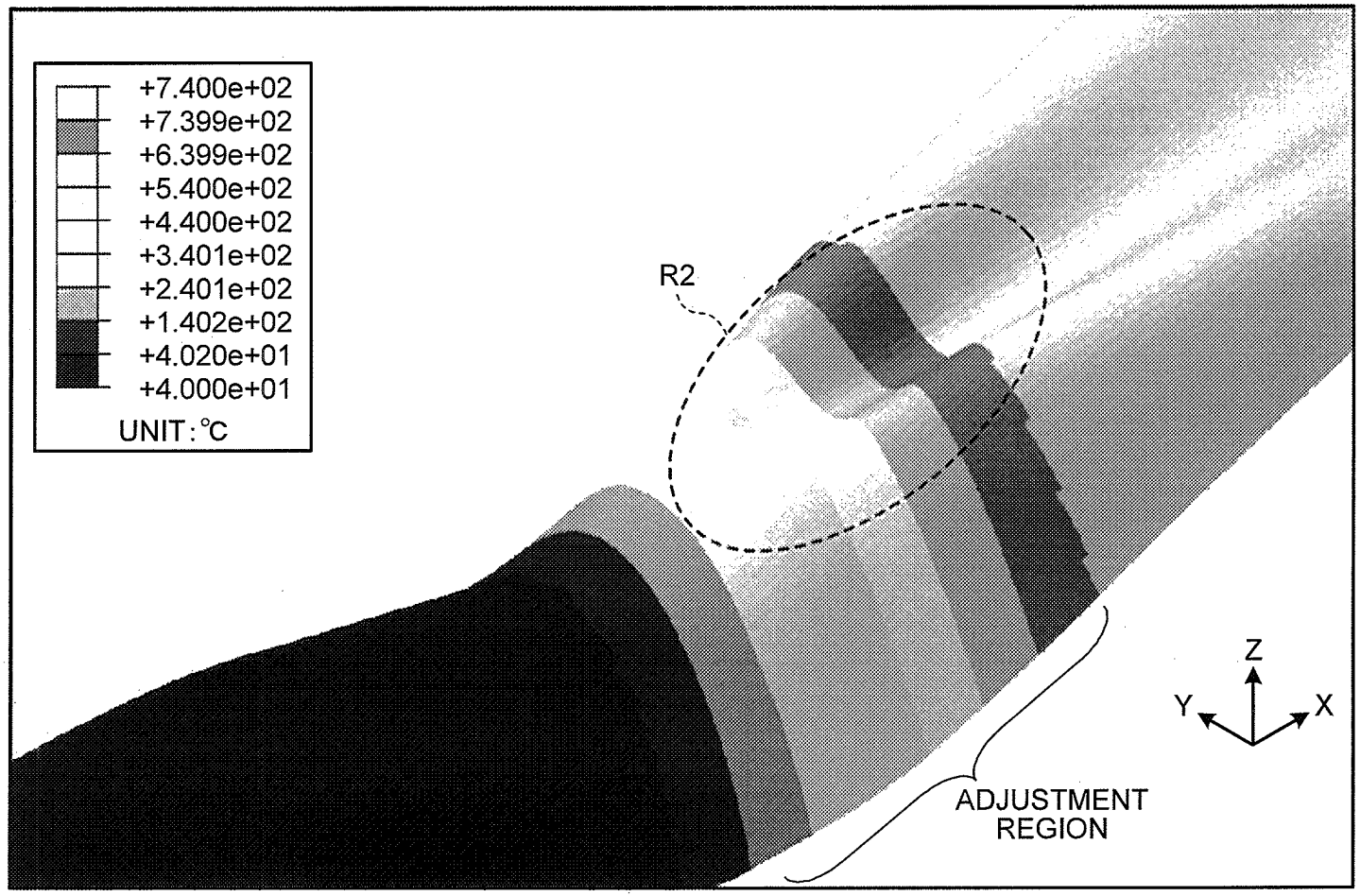
FIG. 3 is a diagram illustrating a simulation result of the steel sheet shape in the case of forming the temperature distribution so that the isotherms have a concave circular arc pattern with respect to the water surface of the water quenching device.
Figure 5B:
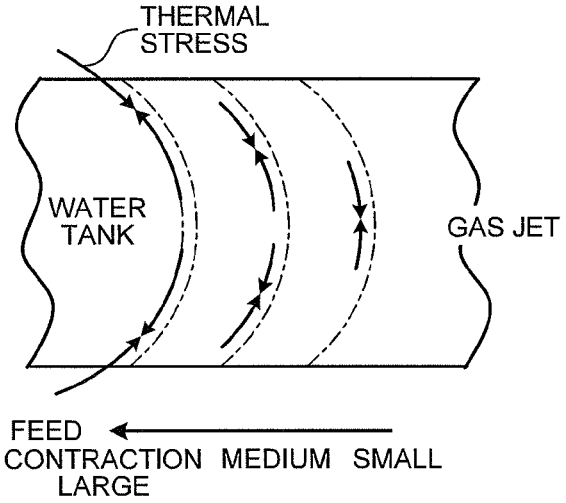
FIG. 5B is a schematic diagram explaining a state of thermal stresses on the sheet surface in the case of forming the temperature distribution so that the isotherms have a concave circular arc pattern with respect to the water surface of the water quenching device.
Figure 6B:
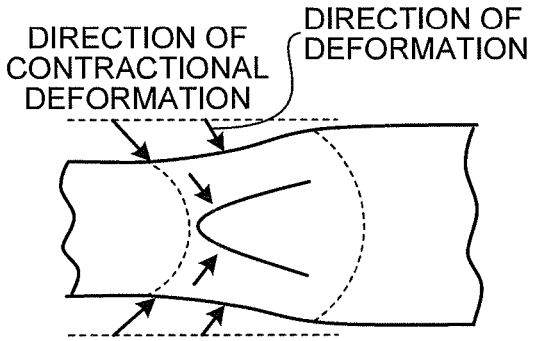
FIG. 6B is a schematic diagram explaining a shape of the sheet surface in the case of forming the temperature distribution so that the isotherms have a concave circular arc pattern with respect to the water surface of the water quenching device.
Figure 7B:
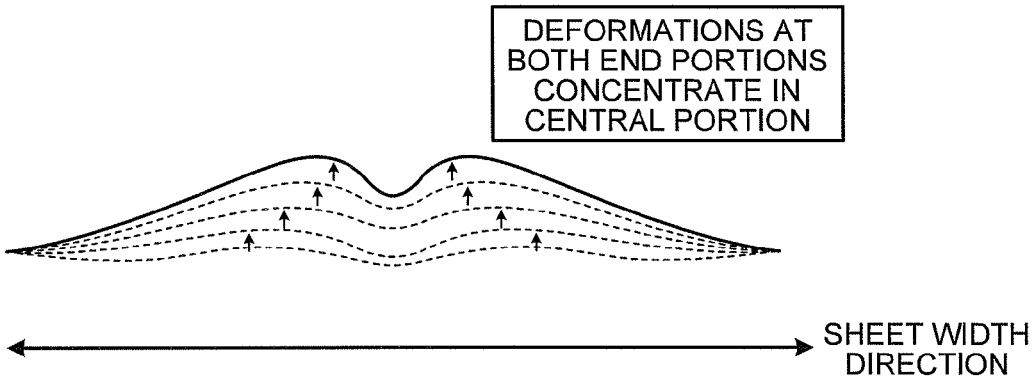
FIG. 7B is a schematic diagram explaining changes in deformation state of the steel sheet (deformation state of the cross section) in the case of forming the temperature distribution so that the isotherms have a concave circular arc pattern with respect to the water surface of the water quenching device.

FIG. 3 is a diagram illustrating a simulation result of the steel sheet shape in the case of forming the temperature distribution so that the isotherms have a concave circular arc pattern with respect to the water surface of the water quenching device (simulation model illustrated in FIG. 1B). As illustrated in FIG. 3, it is found that, in the case in which the temperature distribution is formed so that the isotherms have a concave circular arc pattern with respect to the water surface of the water quenching device, the flatness of the steel sheet is greatly spoiled because the steel sheet greatly buckles in a central portion R2 of the adjustment region although the steel sheet is not deformed in a wrinkle pattern in the sheet width direction. The reason is considered as follows: In the case in which the temperature distribution is formed so that the isotherms have a concave circular arc pattern with respect to the water surface of the water quenching device, the temperature is lower in the central portion in the sheet width direction than in both end portions in the sheet width direction; therefore, as illustrated in FIGS. 5B, 6B, and 7B, thermal stresses associated with thermal contraction occur from both end portions in the sheet width direction toward the central portion in the sheet width direction, and thus, the thermal stresses concentrate in the central portion in the sheet width direction.

(Case of Forming Isotherms in Convex Shapes with Respect to Water Surface)

Figure 4:
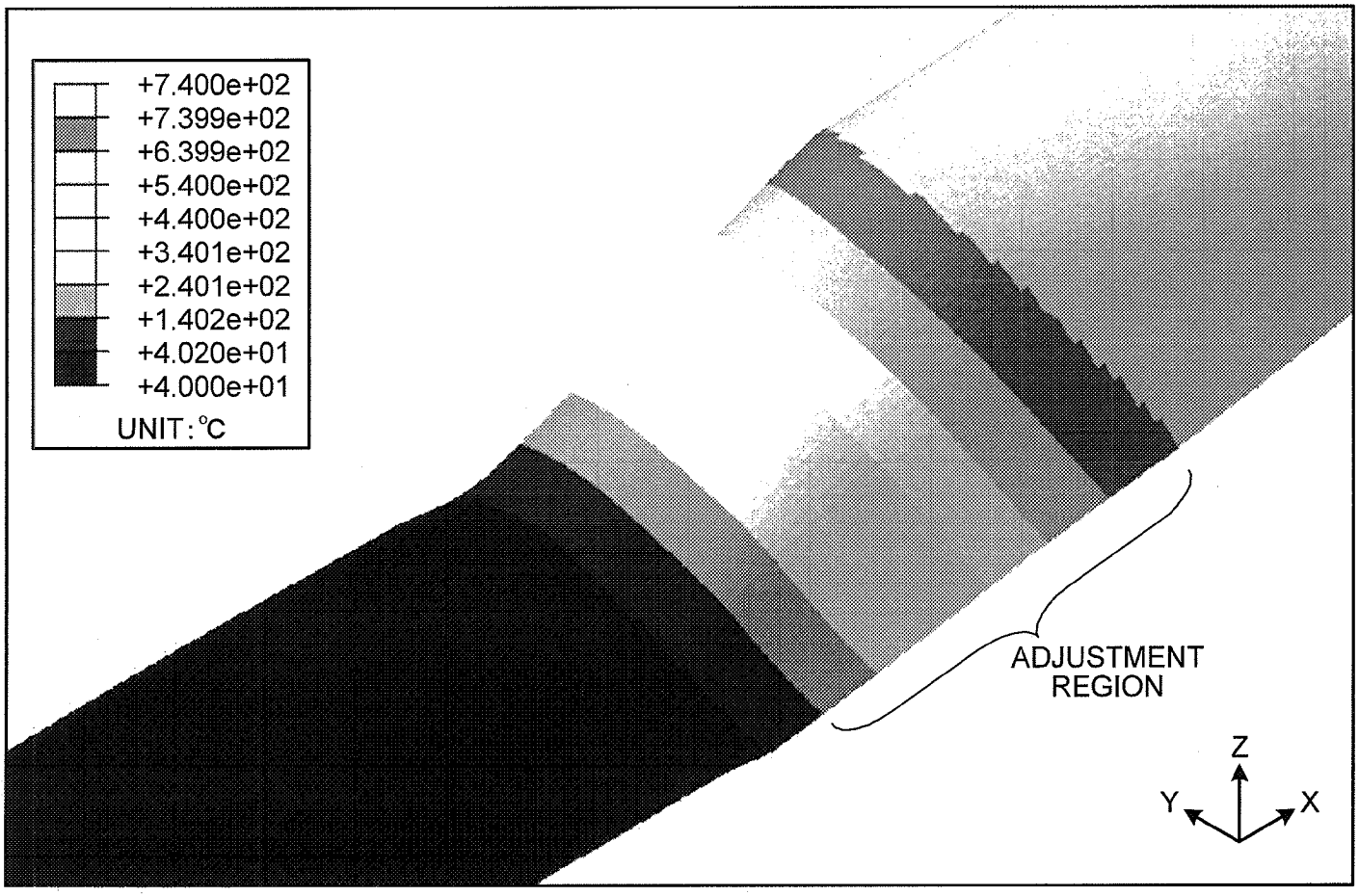
FIG. 4 is a diagram illustrating a simulation result of the steel sheet shape in the case of forming the temperature distribution so that the isotherms have a convex circular arc pattern with respect to the water surface of the water quenching device.
Figure 5C:
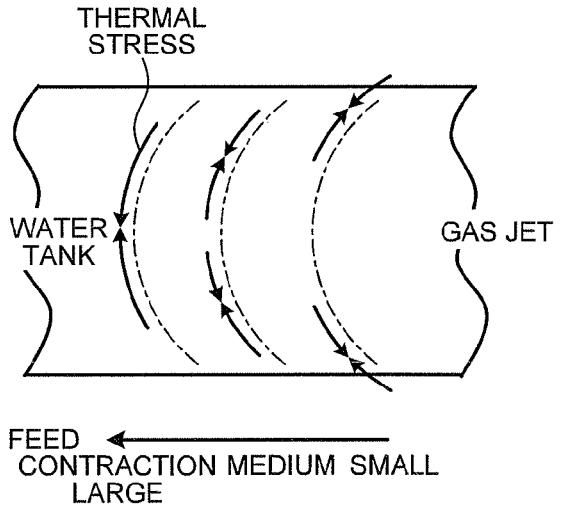
FIG. 5C is a schematic diagram explaining a state of thermal stresses on the sheet surface in the case of forming the temperature distribution so that the isotherms have a convex circular arc pattern with respect to the water surface of the water quenching device.
Figure 6C:
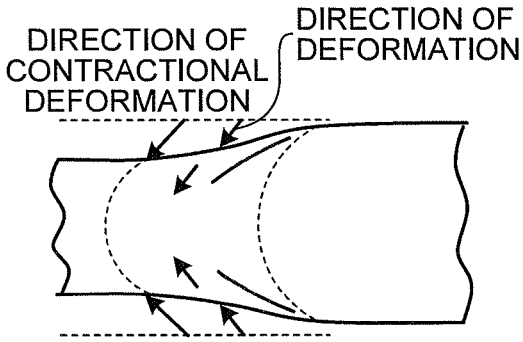
FIG. 6C is a schematic diagram explaining a shape of the sheet surface in the case of forming the temperature distribution so that the isotherms have a convex circular arc pattern with respect to the water surface of the water quenching device.
Figure 7C:
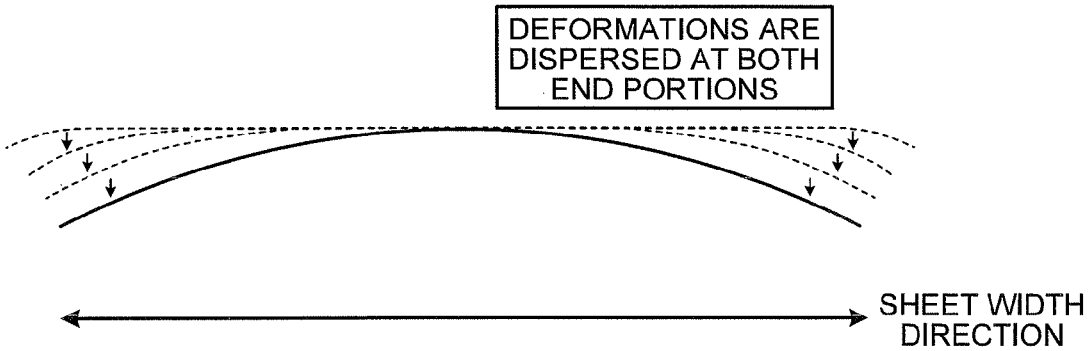
FIG. 7C is a schematic diagram explaining changes in deformation state of the steel sheet (deformation state of the cross section) in the case of forming the temperature distribution so that the isotherms have a convex circular arc pattern with respect to the water surface of the water quenching device.

FIG. 4 is a diagram illustrating a simulation result of the steel sheet shape in the case of forming the temperature distribution so that the isotherms have a convex circular arc pattern with respect to the water surface of the water quenching device (simulation model illustrated in FIG. 1C). As illustrated in FIG. 4, it is found that, in the case in which the temperature distribution is formed so that the isotherms have a convex circular arc pattern with respect to the water surface of the water quenching device, neither wrinkle-like deformation nor buckling occurs although the steel sheet is deformed into a circular arc shape in the sheet width direction. The reason is considered as follows: In the case in which the temperature distribution is formed so that the isotherms have a convex circular arc pattern with respect to the water surface of the water quenching device, the temperature is lower in both end portions in the sheet width direction than in the central portion in the sheet width direction; therefore, as illustrated in FIGS. 5C and 6C, thermal stresses associated with thermal contraction occur from the central portion in the sheet width direction toward both end portions in the sheet width direction, and thus, the thermal stresses are dispersed to one end portion and the other end portion in the sheet width direction. In this case, as illustrated in FIG. 7C, it is considered as follows: Until the steel sheet is immersed into the water quenching device, deformed regions of a circular arc shape occur at both end portions in the sheet width direction; then, the two deformed regions are connected to each other in the water quenching device; and the connected deformed regions exhibit a circular arc pattern as a whole.

As described above, the inventors of the present invention have analyzed the changes in the deformation state of the steel sheet associated with the difference in temperature distribution in the sheet width direction, and as a result, have found that it is possible to suppress wrinkle-like deformation in the width direction of a steel sheet by forming a temperature distribution so that the isotherms have a convex circular arc pattern with respect to the water surface of the water quenching device, or in other words, by forming a temperature distribution in which temperature increases in the width direction of the steel sheet from both end portions in the sheet width direction toward the central portion in the sheet width direction. Description will be made below of a method and an apparatus of manufacturing a high strength cold rolled steel sheet according to first and second embodiments of the present invention made by the inventors based on the above-described finding.

(Structure of Continuous Annealing Line)

First, with reference to FIG. 8, description will be made of a structure of a continuous annealing line to which the method and apparatus of manufacturing a high strength cold rolled steel sheet according to the first and the second embodiments of the present invention are applied.

Figure 8:
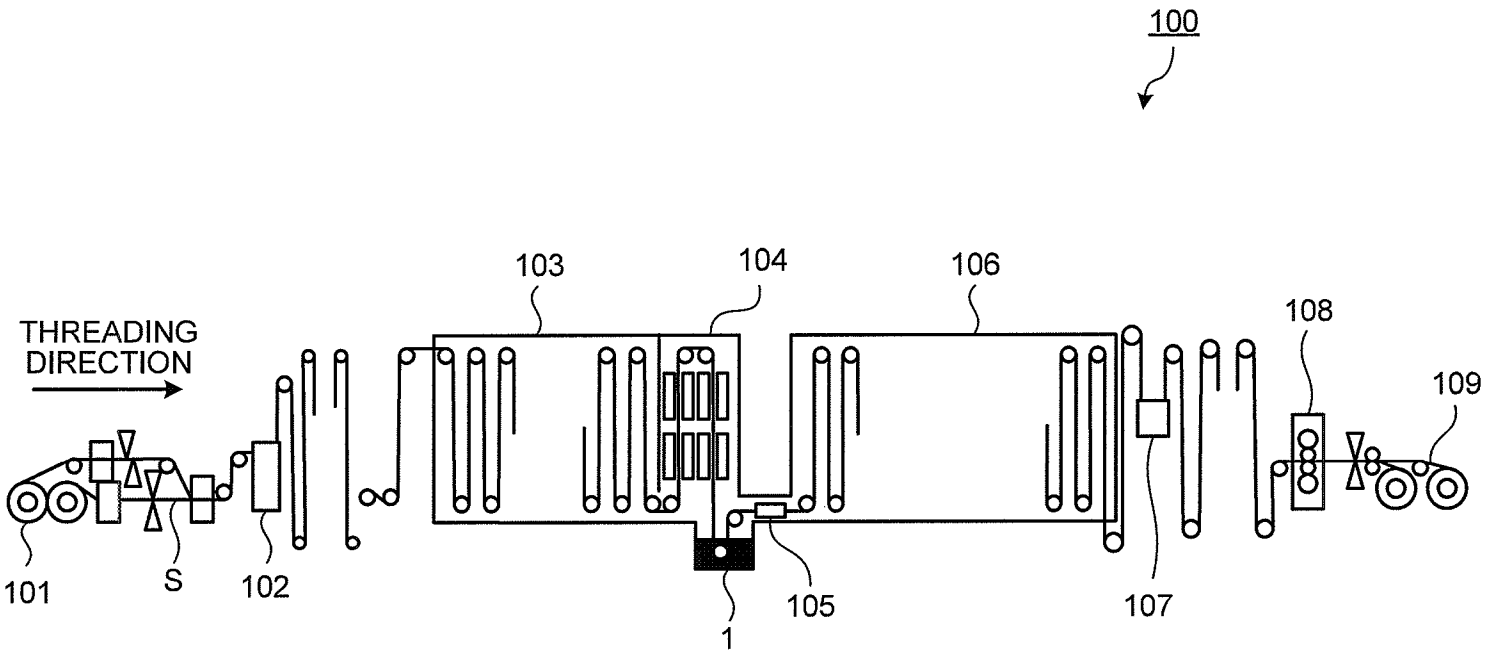
FIG. 8 is a schematic diagram illustrating a structure of a continuous annealing line to which a method and an apparatus of manufacturing a high strength cold rolled steel sheet according to first and second embodiments of the present invention are applied.

FIG. 8 is a schematic diagram illustrating the structure of the continuous annealing line to which the method and apparatus of manufacturing a high strength cold rolled steel sheet according to the first and the second embodiments of the present invention are applied. The method apparatus of manufacturing a high strength cold rolled steel sheet according to the first and the second embodiments of the present invention are applied to a continuous annealing line 100. The continuous annealing line 100 includes an entry-side coiler 101, a cleaning device 102, a heating-soaking zone 103, a gas-jet cooling zone 104, a rapid heating device 105, a reheating zone 106, a pickling device 107, a skin-pass device 108, and an exit-side coiler 109 as illustrated in FIG. 8. A high strength cold rolled steel sheet manufacturing apparatus 1 according to the first and the second embodiments of the present invention is arranged between the gas-jet cooling zone 104 and the rapid heating device 105.

In the continuous annealing line 100 as described above, the steel sheet S wound off from the entry-side coiler 101 is cleaned in the cleaning device 102, and then introduced to the heating-soaking zone 103. Next, after being heated and soaked in the heating-soaking zone 103, the steel sheet S is cooled in the gas-jet cooling zone 104. Then, water quenching treatment is applied to the steel sheet S in the high strength cold rolled steel sheet manufacturing apparatus 1 according to the first and the second embodiments of the present invention. Next, the steel sheet S is introduced to the rapid heating device 105 and rapidly heated to a predetermined temperature. Thereafter, tempering heat treatment is applied to the steel sheet S in the reheating zone 106. Then, the steel sheet S after being subjected to the tempering heat treatment is fed via the pickling device 107 and the skin-pass device 108 to the exit-side coiler 109.

First Embodiment

Next, with reference to FIGS. 9A to 100, description will be made of the high strength cold rolled steel sheet manufacturing apparatus 1 according to the first embodiment of the present invention.

Figure 9A:
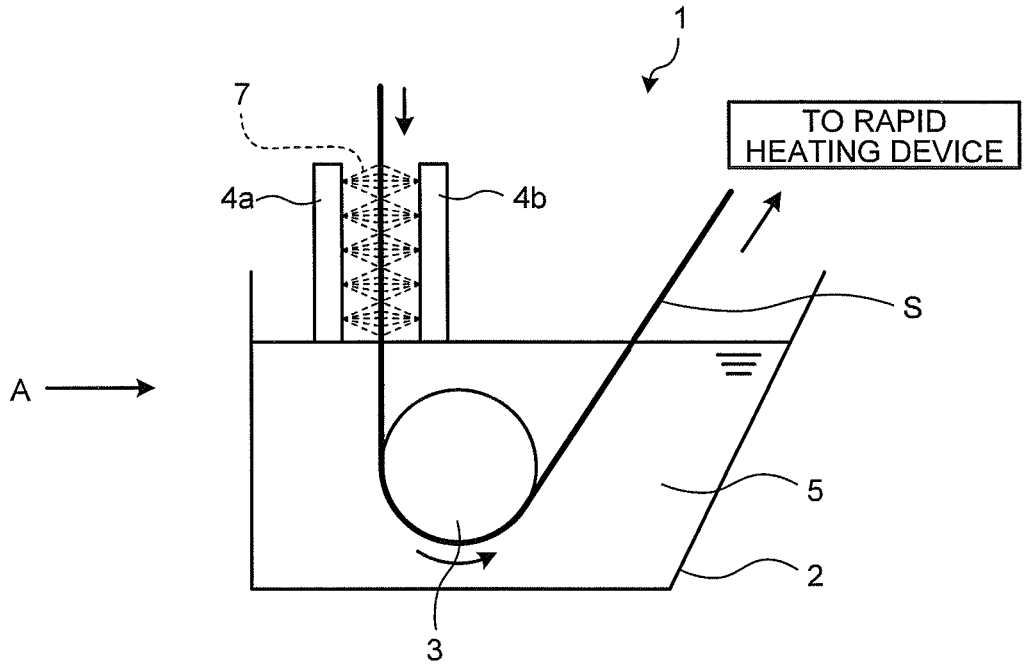
FIG. 9A is a side view illustrating a structure of the manufacturing apparatus of a high strength cold rolled steel sheet according to the first embodiment of the present invention.
Figure 9B:
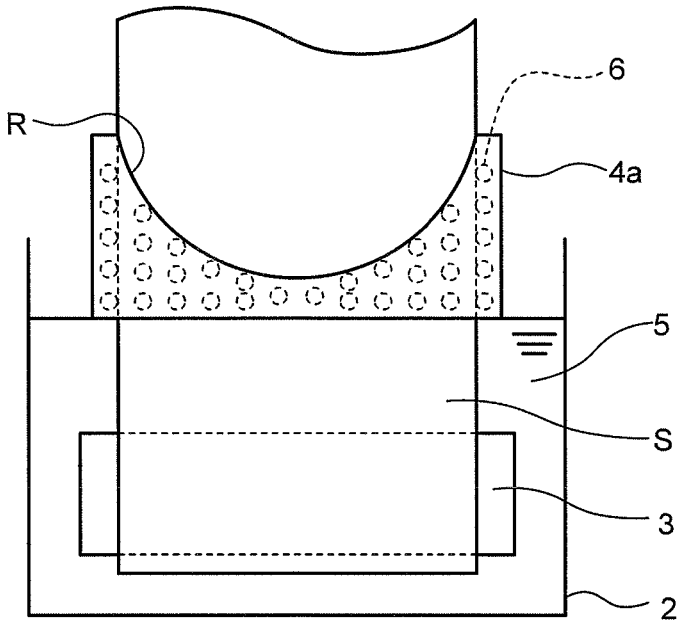
FIG. 9B is a view of the manufacturing apparatus of a high strength cold rolled steel sheet according to the first embodiment of the present invention, as viewed from the direction of arrow A illustrated in FIG. 9A.

FIGS. 9A and 9B are schematic diagrams illustrating a structure of the manufacturing apparatus of a high strength cold rolled steel sheet according to the first embodiment of the present invention. FIG. 9A illustrates a side view, and FIG. 9B is a view as viewed from the direction of arrow A illustrated in FIG. 9A. As illustrated in FIGS. 9A and 9B, the high strength cold rolled steel sheet manufacturing apparatus 1 according to the first embodiment of the present invention comprises a water quenching device applying water quenching treatment to the steel sheet S, and includes a water tank 2, a sink roll 3, and cooling facilities 4*a* and 4*b*. The water tank 2 reserves cooling water 5 used for applying the water quenching treatment to the steel sheet S. The sink roll 3 is composed of a roll-shaped member disposed in the cooling water 5, and is used for changing the feed direction of the steel sheet S fed from the side of the gas-jet cooling zone 104 illustrated in FIG. 8 and feeding the steel sheet S to the side of the rapid heating device 105.

Both the cooling facilities 4*a* and 4*b* are arranged near the water surface of the cooling water 5 reserved in the water tank 2, and are placed in an opposing manner to the steel sheet S before being subjected to the water quenching treatment. Each surface of the cooling facilities 4*a* and 4*b* facing the steel sheet S is formed, at an upper end portion thereof, with a curved surface R of a circular arc shape so as to have a convex circular arc shape with respect to the water surface of the cooling water 5. A plurality of spray nozzles 6 are provided in the facing surfaces. The spray nozzles 6 are arranged so as to become smaller in number from both end portions in the sheet width direction toward the central portion in the sheet width direction. The spray nozzles 6 spray cooling water 7 to the steel sheet S when the steel sheet S passes between the cooling facility 4*a* and the cooling facility 4*b*. The water tank 2 and the cooling facilities 4*a*, 4*b* serve as a water quenching unit and a temperature distribution forming unit, respectively.

Figure 10A:
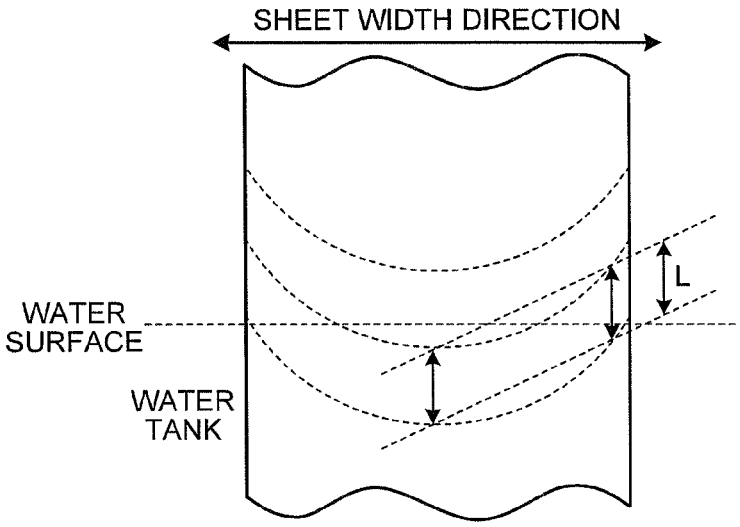
FIG. 10A is a schematic diagram illustrating a temperature distribution in the width direction of a steel sheet in the case in which a cooling capacity of cooling facilities is equal to a cooling capacity of a water tank.
Figure 10B:
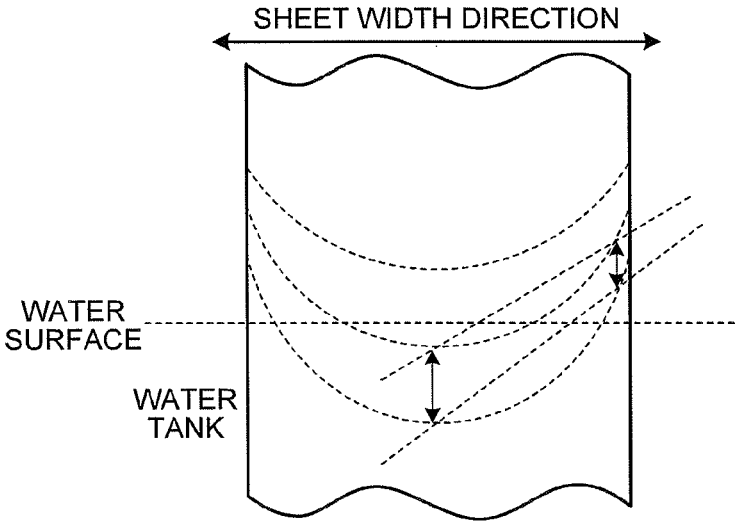
FIG. 10B is a schematic diagram illustrating the temperature distribution in the width direction of the steel sheet in the case in which the cooling capacity of the cooling facilities is higher than the cooling capacity of the water tank.
Figure 10C:
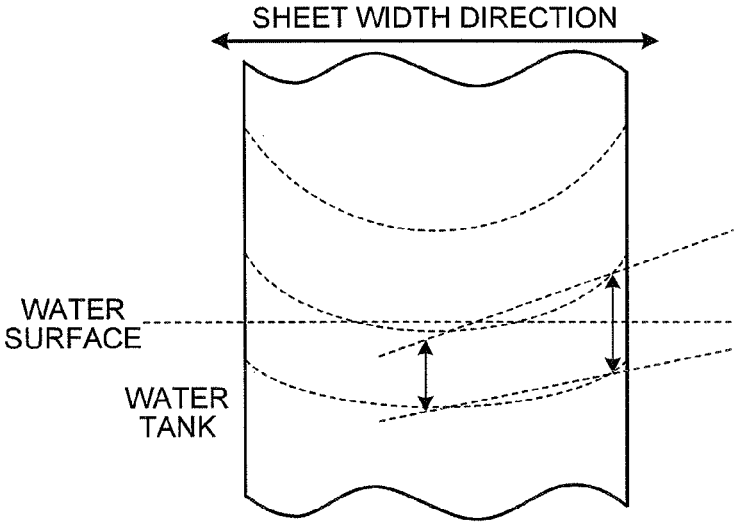
FIG. 10C is a schematic diagram illustrating the temperature distribution in the width direction of the steel sheet in the case in which the cooling capacity of the water tank is higher than the cooling capacity of the cooling facilities.

In the manufacturing apparatus 1 having the structure as described above, the steel sheet S fed from the side of the gas-jet cooling zone 104 illustrated in FIG. 8 is cooled by the cooling water 7 sprayed from the spray nozzles 6 of the cooling facilities 4*a* and 4*b* before being immersed into the cooling water 5 in the water tank 2. At this time, because the spray nozzles 6 are arranged so as to become smaller in number, which is a number accumulated along the feed direction, from both end portions in the sheet width direction toward the central portion in the sheet width direction, a distribution state of isotherms of the steel sheet S exhibits a convex circular arc pattern with respect to the water surface of the cooling water 5, as illustrated in FIGS. 10A, 10B, and 10C. In other words, a temperature distribution is formed in which temperature increases from both width end portions toward the central portion in the sheet width direction on the steel sheet S in the sheet width direction. It is thus possible to suppress wrinkle-like deformation in the width direction of the steel sheet S. In addition, a cooling capacity of the cooling facilities 4*a* and 4*b* can be adjusted by adjusting a water volume so as to be equal to a cooling capacity in the water tank, and thus, intervals L between the isotherms can be made even in the feed direction. The influence of thermal contraction in the feed direction becomes even in the sheet width direction because the steel sheet remains at a constant temperature after reaching a water temperature. If the cooling capacity of the cooling facilities 4*a* and 4*b* is made different from the cooling capacity in the water tank, the intervals L between the isotherms can be varied between the sheet width central portion and the sheet width end portion. Thus, fine-adjusting the cooling capacity allows the circular arc shape to be stabilized.

Second Embodiment

Next, with reference to FIGS. 11A, 11B, and 12, description will be made of the high strength cold rolled steel sheet manufacturing apparatus 1 according to the second embodiment of the present invention.

Figure 11A:
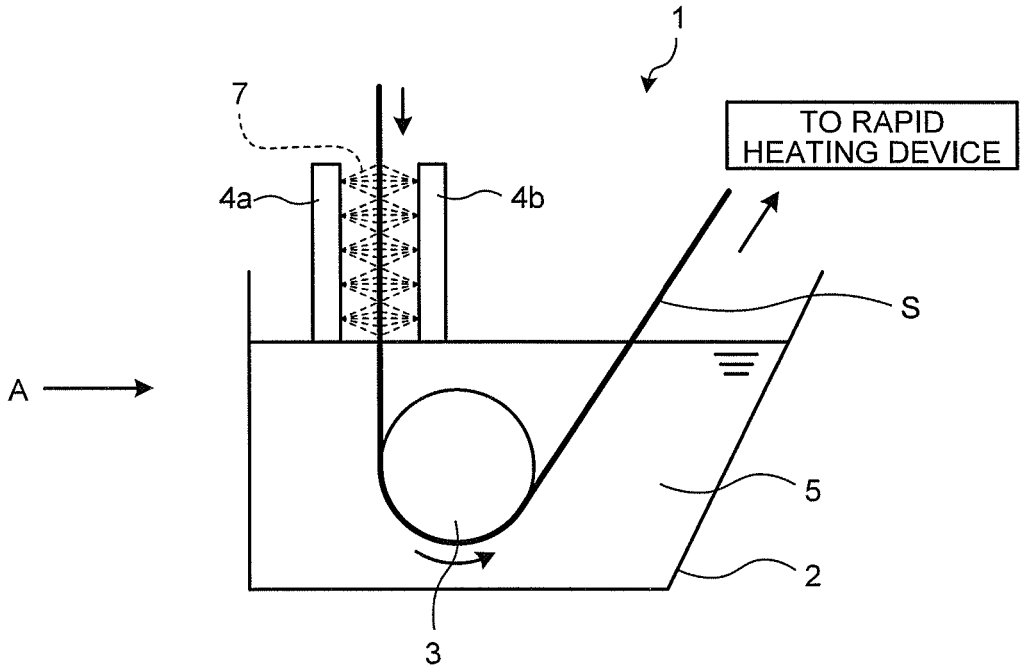
FIG. 11A is a side view illustrating a structure of the manufacturing apparatus of a high strength cold rolled steel sheet according to the second embodiment of the present invention.
Figure 11B:
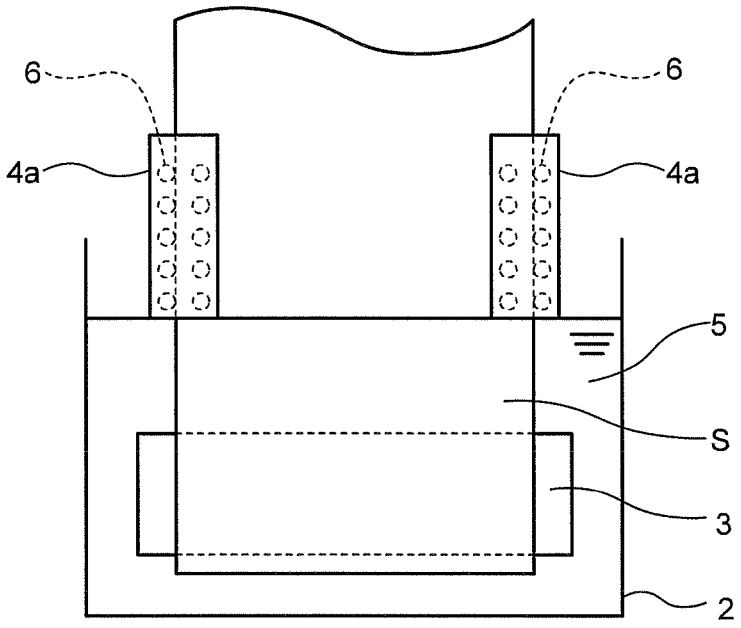
FIG. 11B is a view of the manufacturing apparatus of a high strength cold rolled steel sheet according to the second embodiment of the present invention, as viewed from the direction of arrow A illustrated in FIG. 11A.
Figure 12:
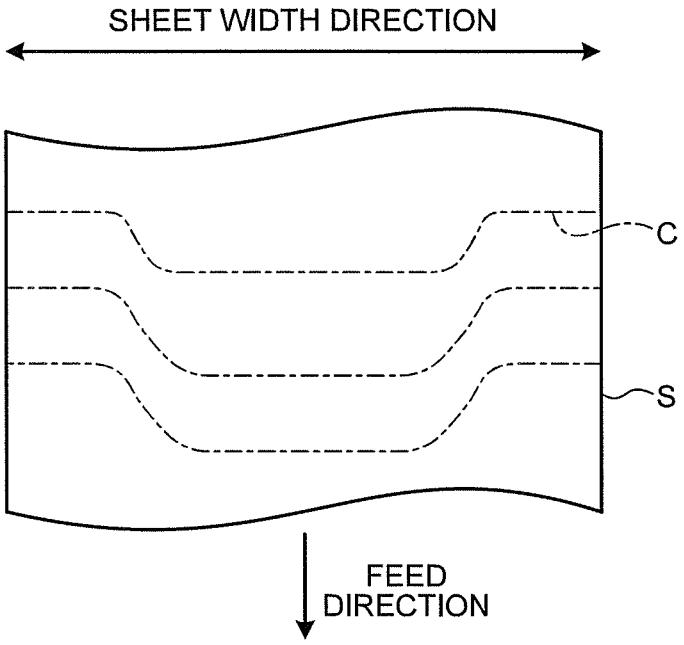
FIG. 12 is a schematic diagram illustrating a temperature distribution in the width direction of a steel sheet that is formed in the case of using the manufacturing apparatus of a high strength cold rolled steel sheet illustrated in FIGS. 11A and 11B.

FIGS. 11A and 11B are schematic diagrams illustrating a structure of the manufacturing apparatus of a high strength cold rolled steel sheet according to the second embodiment of the present invention. FIG. 11A illustrates a side view of the structure, and FIG. 11B is a view of the structure as viewed from the direction of arrow A illustrated in FIG. 11A. As illustrated in FIGS. 11A and 11B, the high strength cold rolled steel sheet manufacturing apparatus 1 according to the second embodiment of the present invention comprises a water quenching device applying water quenching treatment to a steel sheet S, and includes a water tank 2, a sink roll 3, and cooling facilities 4*a* and 4*b*. Note that the structure of the manufacturing apparatus of a high strength cold rolled steel sheet according to the second embodiment of the present invention differs from the structure of the manufacturing apparatus of a high strength cold rolled steel sheet according to the first embodiment of the present invention only in the structure of the cooling facilities 4*a* and 4*b*. Therefore, only the structure of the cooling facilities 4*a* and 4*b* will be described below.

Both the cooling facilities 4*a* and 4*b* are arranged near the water surface of cooling water 5 reserved in the water tank 2, and are placed in an opposing manner near both end portions in the width direction of the steel sheet S. A plurality of spray nozzles 6 are provided in the surfaces of the cooling facilities 4*a* and 4*b* facing the steel sheet S. The spray nozzles 6 spray cooling water 7 to the steel sheet S when the steel sheet S passes between the cooling facility 4*a* and the cooling facility 4*b*. The water tank 2 and the cooling facilities 4*a*, 4*b* serve as the water quenching unit and the temperature distribution forming unit, respectively.

In the manufacturing apparatus 1 having the structure as described above, the steel sheet S fed from the side of the gas-jet cooling zone 104 illustrated in FIG. 8 is cooled by the cooling water 7 sprayed from the spray nozzles 6 of the cooling facilities 4*a* and 4*b* before being immersed into the cooling water 5 in the water tank 2. At this time, because the spray nozzles 6 are disposed near both end portions in the sheet width direction, both end portions in the sheet width direction are cooled. The cooling water 7 sprayed to both end portions in the sheet width direction comes in contact with the steel sheet S, and then, as flowing downward, spreads into the central portion in the sheet width direction. A distribution state of isotherms C of the steel sheet S thus exhibits convex shapes with respect to the water surface of cooling water 5 as illustrated in FIG. 12. In other words, a temperature distribution is formed in which temperature increases from both end portions in the sheet width direction toward the central portion in the sheet width direction on the steel sheet S in the sheet width direction. It is thus possible to suppress wrinkle-like deformation in the width direction of the steel sheet S.

EXAMPLES

Figure 13:
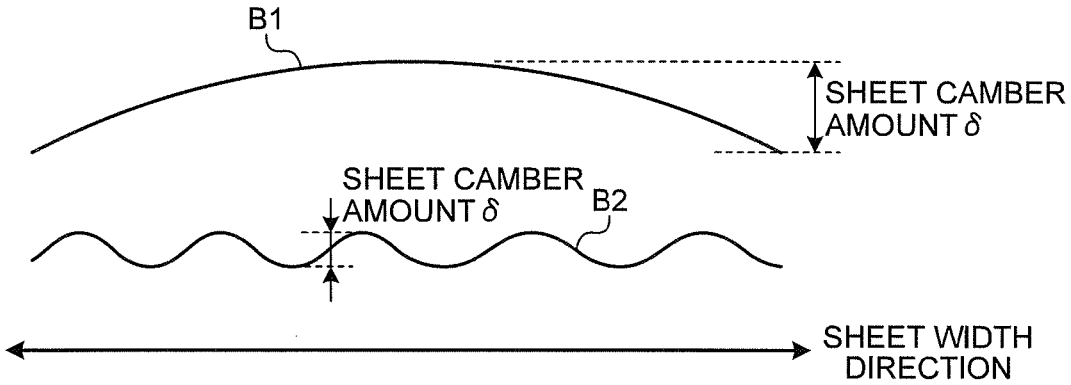
FIG. 13 is a diagram explaining a definition of a sheet camber amount of a steel sheet.

Finally, description will be made of results of experiments conducted to evaluate a sheet camber amount of a steel sheet after being subjected to the water quenching treatment, with respect to each of the manufacturing apparatuses of the first and the second embodiments and a conventional water quenching device. Note that the sheet camber amount δ in the cases of using the manufacturing apparatuses of the first and the second embodiments was calculated, as illustrated in FIG. 13, as a difference in height between the lowest point and the highest point of a curve B1 representing a sheet shape of the steel sheet. Note also that the sheet camber amount δ in the case of using the conventional water quenching device was calculated, as illustrated in FIG. 13, as a difference in height between the lowest point and the highest point of a curve B2 exhibited by wrinkle-like deformation. These experiments used martensitic steel sheets having a tensile strength of 980 MPa class, with different sheet thicknesses of 0.8, 1.2, 1.4, and 1.6 mm, and different sheet widths of 1100, 1200, and 1400 mm, and were conducted at different threading speeds of 80, 95, 110, and 120 mpm. The temperature of the steel sheet before being subjected to the water quenching treatment was set to 720° C., and the temperature of the cooling water in the water tank was set to 46° C.

Examples 1 to 4

In each of examples 1 to 4, the water quenching treatment was applied to the steel sheet by using the manufacturing apparatus of the first embodiment, and thereafter, the sheet camber amount δ of the steel sheet was evaluated. In each of the present examples 1 to 4, each of the cooling facilities 4*a* and 4*b* had an upper end surface of a circular arc-shaped curved surface shape (convex shape) with a diameter of 2000 mm, and the spray nozzles 6 sprayed the cooling water 7 at a flow rate of 4000 L/($m^2$·min). The tensile force of the steel sheet S was set to 9.8 N/$mm^2$. The cooling water 7 was sprayed from the spray nozzles 6 in a direction slightly downward from the horizontal direction so that the cooling water sprayed to the steel sheet S would not be blown up toward the facing surfaces of the cooling facilities. The sheet camber amount δ of the steel sheet S in each of the experiments is illustrated in Table 1 below.

Examples 5 to 8

In each of examples 5 to 8, the water quenching treatment was applied to the steel sheet by using the manufacturing apparatus of the second embodiment, and thereafter, the sheet camber amount δ of the steel sheet was evaluated. In each of the present examples 5 to 8, the cooling facilities 4*a* and 4*b* were arranged from a level at a height of 300 mm from the water surface of the cooling water 5 with clearances of 100 mm from the steel sheet, and arranged so as to cool regions ranging from both end of the steel sheet S to distances of approximately 50 mm from both ends. The spray nozzles 6 sprayed the cooling water 7 at a flow rate of 2000 L/($m^2$·min). The tensile force of the steel sheet S was set to 4.9 N/$mm^2$. The cooling water 7 was sprayed from the spray nozzles 6 in a direction slightly downward from the horizontal direction so that the cooling water sprayed to the steel sheet S would not be blown up toward the facing surfaces of the cooling facilities. The sheet camber amount δ of the steel sheet S in each of the experiments is illustrated in Table 1 below.

Comparative Examples 1 to 4

In each of comparative examples 1 to 4, the water quenching treatment was applied to the steel sheet without using the cooling facilities 4*a* and 4*b*, and thereafter, the sheet camber amount δ of the steel sheet was evaluated. In each of comparative examples 1 to 4, the tensile force of the steel sheet S was set to 4.9 N/$mm^2$. The sheet camber amount δ of the steel sheet S in each of the experiments is illustrated in Table 1 below.

| | Cooling Facilities | Quenching temperature [° C.] | Sheet thickness [mm] | Sheet width [mm] | Threading speed [mpm] | Sheet Camber Amount δ [mm] |
|---|---|---|---|---|---|---|
| Example 1 | Convex shape | 720 | 1.6 | 1100 | 80 | 2 |
| Example 2 | Convex shape | 720 | 1.4 | 1400 | 95 | 2 |
| Example 3 | Convex shape | 720 | 1.2 | 1200 | 110 | 1 |
| Example 4 | Convex shape | 720 | 0.8 | 1100 | 120 | 1 |
| Example 5 | End Portions Cooling | 720 | 1.6 | 1100 | 80 | 5 |
| Example 6 | End Portions Cooling | 720 | 1.4 | 1400 | 95 | 3 |
| Example 7 | End Portions Cooling | 720 | 1.2 | 1200 | 110 | 4 |
| Example 8 | End Portions Cooling | 720 | 0.8 | 1100 | 120 | 2 |
| Comparative example 1 | None | 720 | 1.6 | 1100 | 80 | 64 |
| Comparative example 2 | None | 720 | 1.4 | 1400 | 95 | 50 |
| Comparative example 3 | None | 720 | 1.2 | 1200 | 110 | 37 |
| Comparative example 4 | None | 720 | 0.8 | 1100 | 120 | 41 |

(Evaluation)

As illustrated in Table 1, it has been found that the sheet camber amount δ can be significantly reduced by applying the water quenching treatment of the examples 1 to 8 compared with the cases of applying the water quenching treatment of the comparative examples 1 to 4. From this finding, the following has been able to be confirmed: By providing the cooling facilities 4*a* and 4*b* and forming, in the width direction of the steel sheet S, a temperature distribution in which temperature increases from both end portions in the sheet width direction toward the central portion in the sheet width direction, it is possible to reduce the sheet camber amount δ of the entire steel sheet while suppressing wrinkle-like deformation in the width direction of the steel sheet. In addition, when comparing the water quenching treatment of the examples 1 to 4 with the water quenching treatment of the examples 5 to 8, it is found that the water quenching treatment of the examples 1 to 4 can reduce the sheet camber amount δ by an amount more than in the case of the water quenching treatment of the examples 5 to 8. From this finding, the following has been able to be confirmed: By forming a temperature distribution so that the distribution state of isotherms of the steel sheet S exhibits a convex circular arc pattern with respect to the water surface of the cooling water 5, the sheet camber amount δ can be further reduced.

The description has been made above of the embodiments to which the invention created by the inventors of the present invention is applied. However, the present invention is not limited by the description or the drawings forming a part of the disclosure of the present invention by the present embodiments. For example, in the present embodiments, the temperature distribution is formed in the width direction of the steel sheet so that the isotherms have convex shapes with respect to the water surface of the water quenching device. However, the present invention is not limited to the present embodiments. The isotherms may have a shape, such as a triangular shape or a stepwise shape, other than a curved shape as far as the steel sheet is formed, in the sheet width direction, with a temperature distribution in which temperature increases from both end portions in the sheet width direction toward the central portion in the sheet width direction. Thus, other embodiments, examples, operational techniques, and the like that are made based on the present embodiments by those skilled in the art are all included in the category of the present invention.

REFERENCE SIGNS LIST

1 Manufacturing apparatus
2 Water tank
3 Sink roller
4*a*, 4*b* Cooling device
5, 7 Cooling water
6 Spray nozzle
S Steel sheet

The invention claimed is:

1. A method for manufacturing a high-strength cold-rolled steel sheet performed by using a manufacturing apparatus for manufacturing a high-strength cold-rolled steel sheet, the manufacturing apparatus disposed between an upstream gas-jet cooling zone and a downstream rapid heating device in a continuous annealing line and including a cooling facility that forms a temperature distribution in a steel sheet by spraying cooling water, the method comprising:

a temperature distribution forming step of forming, by the cooling facility, a temperature distribution in a width direction of a steel sheet such that a temperature of the steel sheet increases from an end of the steel sheet in the width direction toward a center part of the steel sheet in the width direction; and a water quenching step of performing water quenching treatment on the steel sheet by immersing, in cooling water, the steel sheet on which the temperature distribution is formed in the width direction.

2. The method for manufacturing a high-strength cold-rolled steel sheet according to claim 1, wherein the temperature distribution forming step includes a step of forming the temperature distribution in the width direction of the steel sheet such that isothermal lines on the steel sheet have a convex circular shape relative to water surface of the cooling water.

3. The method for manufacturing a high-strength cold-rolled steel sheet according to claim 1, wherein the temperature distribution forming step includes a step of cooling both ends of the steel sheet in the width direction.

4. A manufacturing apparatus disposed between an upstream gas-jet cooling zone and a downstream rapid heating device in a continuous annealing line for manufacturing a high-strength cold-rolled steel sheet, the manufacturing apparatus comprising:

a temperature distribution forming unit that forms a temperature distribution in a width direction of a steel sheet by spraying cooling water such that a temperature of the steel sheet increases from an end of the steel sheet in the width direction toward a center part of the steel sheet in the width direction; and a water quenching unit that performs water quenching treatment on the steel sheet by immersing, in cooling water, the steel sheet on which the temperature distribution is formed in the width direction by the temperature distribution forming unit.

* * * * *